US009723910B2

(12) United States Patent
Due

(10) Patent No.: US 9,723,910 B2
(45) Date of Patent: Aug. 8, 2017

(54) DEVICE ATTACHMENT FOR HOLDING A DEVICE

(71) Applicant: BULLZ-I INC., San Mateo, CA (US)

(72) Inventor: Eric W. Due, San Mateo, CA (US)

(73) Assignee: BULLZ-I INC., San Mateo, CA (US)

( * ) Notice: Subject to any disclaimer, the term of this patent is extended or adjusted under 35 U.S.C. 154(b) by 0 days.

(21) Appl. No.: 15/172,221

(22) Filed: Jun. 3, 2016

(65) Prior Publication Data

US 2016/0353867 A1 Dec. 8, 2016

Related U.S. Application Data

(60) Provisional application No. 62/171,284, filed on Jun. 5, 2015.

(51) Int. Cl.
*A45F 5/10* (2006.01)

(52) U.S. Cl.
CPC ..... *A45F 5/10* (2013.01); *A45F 2200/0508* (2013.01); *A45F 2200/0516* (2013.01); *A45F 2200/0525* (2013.01)

(58) Field of Classification Search
CPC ..... A45F 5/10; A45F 2200/0508; A45F 2200/0516; A45F 2200/0525; H04M 1/0281
USPC ..... 294/25; 224/217, 930
See application file for complete search history.

(56) References Cited

U.S. PATENT DOCUMENTS 1,094,888 A * 4/1914 Ehrle ..... B43K 23/012 15/443
4,606,484 A * 8/1986 Winter ..... A46B 5/00 224/218
5,786,593 A 7/1998 Ohtomo et al.
D503,717 S 4/2005 Kawamura
(Continued)

FOREIGN PATENT DOCUMENTS

CN 203423721 U 2/2014
KR 101485921 B1 1/2015
WO 2016196907 A1 12/2016

OTHER PUBLICATIONS

"The Ring, Your Phone's Perfect Mate", by Bullz-i (Kickstarter), https://www.kickstarter.com/projects/bulz-i/the-ring-your-phones-perfect-mate/description (accessed Aug. 1, 2016), Jan. 12, 2016, 14 Pages.

(Continued)

*Primary Examiner* — Dean Kramer
(74) *Attorney, Agent, or Firm* — GTC Law Group PC & Affiliates

(57) ABSTRACT

An attachment to a mobile device, allowing a user to grasp and use the device. The attachment may include three concentric, interlocking rings. An outer ring adhered to a backing plate may be affixed to a surface of a device, such as a rear surface of a cell phone, smart phone, personal digital assistant, calculator, MP3 player, iPod, iPad, tablet computer or other mobile device. An inner ring attaches to a middle ring via a hinge mount. The grasping device may resemble a ring for a finger of a user, by which a user grasps the attachment and thus the mobile device. The inner and outer rings may be connected and interlocked by a mating middle ring. The middle ring allows the inner ring to rotate relative to the outer ring, allowing the user to conveniently (Continued)

position or orient the mobile device as desired. Other shapes may be used.

11 Claims, 7 Drawing Sheets

(56) References Cited

U.S. PATENT DOCUMENTS

| | | | | |
|---|---|---|---|---|
| D581,418 | S | 11/2008 | Diccion | |
| D598,919 | S | 8/2009 | Takemasa et al. | |
| 7,661,567 | B2 * | 2/2010 | Myers | A45C 13/20 224/162 |
| D613,291 | S | 4/2010 | Carver | |
| D613,292 | S | 4/2010 | Carver | |
| D632,949 | S | 2/2011 | Rowley | |
| D719,961 | S | 12/2014 | Xiang et al. | |
| D729,655 | S | 5/2015 | Bauer et al. | |
| D730,225 | S | 5/2015 | Behar | |
| D733,147 | S | 6/2015 | Stevens et al. | |
| D737,824 | S | 9/2015 | Jagadish et al. | |
| D740,750 | S | 10/2015 | Mayden et al. | |
| D741,256 | S | 10/2015 | Murphy-Reinhertz et al. | |
| 9,179,565 | B2 * | 11/2015 | Cho | H05K 7/00 |
| 9,204,710 | B1 * | 12/2015 | Burns | A45F 5/00 |
| D747,317 | S | 1/2016 | Oakley | |
| D751,558 | S | 3/2016 | Lee | |
| D755,182 | S | 5/2016 | Bassett et al. | |
| D768,635 | S | 10/2016 | Due | |
| 2004/0233676 | A1 | 11/2004 | Matts et al. | |
| 2006/0186161 | A1 | 8/2006 | Huang | |
| 2011/0266316 | A1 | 11/2011 | Ghalib et al. | |
| 2013/0061990 | A1 | 3/2013 | Syma | |
| 2013/0300141 | A1 * | 11/2013 | Byrne | A45F 5/00 294/25 |
| 2014/0064651 | A1 | 3/2014 | Beyfuss et al. | |
| 2015/0122852 | A1 * | 5/2015 | Feng | A45F 5/00 224/191 |

OTHER PUBLICATIONS

PCT/US2016/035684, "Application Serial No. PCT/US2016/035684, International Search Report and the Written Opinion", Bullz-i Inc., mailed Oct. 17, 2016, 11 pages.

* cited by examiner

FIG. 11
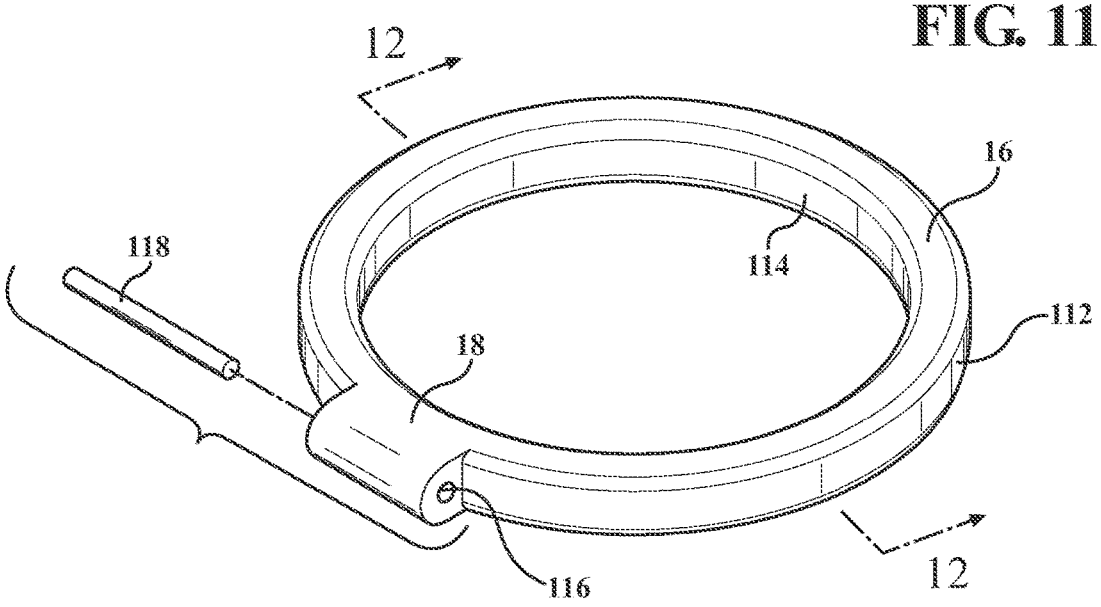
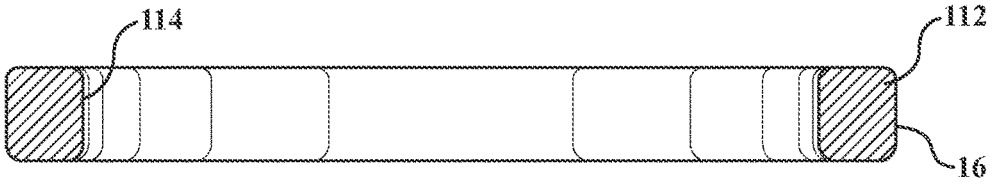
FIG. 12

DEVICE ATTACHMENT FOR HOLDING A DEVICE

RELATED APPLICATIONS

This application claims priority to U.S. Provisional Patent Application 62/171,284, of the same title, filed on Jun. 5, 2015, which is hereby incorporated by reference in its entirety.

BACKGROUND

Field

The present disclosure is generally related to a device for attaching to a mobile device, allowing a user of the mobile device to grasp and manipulate the device in a secure manner.

Description of the Related Art

Personal digital assistants, portable music players, cell phones, and other mobile devices have become omni-present indispensable devices in frequent use throughout a user's day. They are so important that owners dread dropping these devices and harming them. Owners also dread exposing them to environments known to be injurious, such as water or other liquids.

Attempts to prevent harm to such devices include a variety of colorful and impact-resistant plastic and rubberized shells, which cushion the inner electronics in the event of a drop or other impact. Plastic waterproof covers may also be helpful. Shells, however, tend to cover only one larger surface of the device, such as a back surface, and perhaps the sides, thus leaving unprotected large areas, such as the user's screen. Plastic covers may provide more protection, but must typically be removed or opened in order to use the device. Shells and waterproof covers also typically conform to the basic form of the device and therefore do not offer the device user an enhanced grip apart from that perhaps provided by the rubberized surface or texture of the shell. Mobile device attachments that currently exist are either fixed in their placement on a mobile device, forcing a limited range of motion as regards positions in which a user may hold the device and/or the device attachment is bulky, making it difficult for a user to, for example, place the device in a pocket or carrying case as would be possible were it not for the bulk of the device attachment.

Therefore, what is needed is a collapsible apparatus offering a range of rotation that may be affixed to a mobile device and used to hold and support the device.

SUMMARY

In accordance with an exemplary and non-limiting embodiment, the device attachment may include an outer ring attached to a backing plate for securing to a surface of the device, wherein a first recessed area extends the inner circumference of the outer ring for accommodating a lock ring. A middle ring may be adapted to fit between the outer ring and an inner ring, the middle ring comprising a second recessed area extending the outer circumference of the middle ring for accommodating the lock ring. The lock ring may be secured in the first and second recessed areas, the lock ring securing the middle ring to the outer ring, wherein the secured lock ring allows the middle ring to swivel or rotate 360-degrees, or less than 360-degrees, along a plane that is parallel to the backing plate. The inner ring may be adapted to fit within the middle ring, the inner ring comprising a hinge mount on an outer portion of the inner ring that is affixed to the middle ring using a lock pin.

In embodiments, the device attachment may be adapted for securing to the device via a layer of adhesive on a bottom surface of the backing plate.

In embodiments, the lock pin may be adapted to secure the hinge mount to the middle ring.

In embodiments, the inner ring may have a 90-degree freedom of movement between a closed position and a fully open position.

In embodiments, the inner ring may have a greater than 90-degree freedom of movement between a closed position and a fully open position, based at least in part on utilizing a spring hinge or some other type of hinge or pivot.

In accordance with an exemplary and non-limiting embodiment, the device attachment may include an outer ring attached to a backing plate for securing to a surface of the device, wherein a first recessed area extends the inner circumference of the outer ring for accommodating a lock ring. A middle ring may be adapted to fit between the outer ring and an inner ring, the middle ring comprising a second recessed area extending the outer circumference of the middle ring for accommodating the lock ring. The lock ring may be secured in the first and second recessed areas, the lock ring securing the middle ring to the outer ring, wherein the secured lock ring allows the middle ring to swivel or rotate 360 degrees, or less than 360-degrees, along a plane that is parallel to the backing plate. The inner ring may be adapted to fit within the middle ring, the inner ring comprising a hinge mount on an outer portion of the inner ring that is affixed to the middle ring using a lock pin. A pre-applied layer of adhesive may be provided to the backing plate, protected by a removable outer cover, wherein the adhesive allows affixing the backing plate to a surface of the device.

In embodiments, the inner ring may be secured to the middle ring via a lock pin, the lock pin providing a hinge point allowing movement of the inner ring.

In embodiments, the inner ring and the middle ring may form a flat surface when the attachment is in a closed position.

In embodiments, the inner ring may have a shape selected from the group consisting of generally square shape, a rounded square shape, a generally rectangular shape, a rounded rectangular shape and a generally oval or elliptical shape, and a square or rectangular shape.

In embodiments, the inner ring may have generally circular inner and outer shapes.

In embodiments, the lock ring may have a shape selected from the group consisting of a generally round shape and a generally oval or elliptical shape.

In embodiments, the inner ring may have a 90-degree freedom of movement between a closed position and a fully open position.

Another embodiment is an attachment for grasping a device. The device includes an outer ring for securing to a surface of the device, an inner ring adapted to fit within the outer ring, the inner ring adapted for grasping by a user and comprising a pivot mount on an outer portion of the inner ring, a middle ring adapted to fit between the outer ring and the inner ring, the middle ring comprising a gap for accommodating the pivot mount when the inner ring is assembled with the middle ring, and a lock ring for assembly between the outer ring and the middle ring, the lock ring securing the middle ring to the outer ring, the attachment allowing a user to grasp the device.

Another embodiment is an attachment for a grasping a device. The attachment includes an outer portion for securing to a surface of the device, an inner ring adapted to fit within the outer portion, the inner ring adapted for grasping by a user and comprising a pivot mount on an outer portion of the inner ring, a middle portion adapted to fit between the outer portion and the inner ring, the middle portion comprising a gap for accommodating the pivot mount when the inner ring is assembled with the middle portion and a lock ring for assembly between the outer portion and the middle portion, the lock ring securing the middle portion to the outer portion, the attachment allowing a user to grasp the device.

Another embodiment is an attachment for holding or supporting a device. The attachment includes an outer ring attached to a backing plate for securing the backing plate to a surface of the device, the outer ring including a first recessed area on an inner surface of the outer ring and a middle ring adapted to fit within the outer ring and adjacent to the outer ring, the middle ring comprising a second recessed area on an outer surface of the middle ring. The attachment also includes a lock ring for assembly into the first and second recessed areas to secure the middle ring to the outer ring, wherein the lock ring allows the middle ring to rotate within a plane parallel to the backing plate and an inner ring adapted to fit within the middle ring, the inner ring comprising a hinge mount on an outer portion of the inner ring.

In embodiments, the attachment further includes a layer of adhesive on a bottom surface of the backing plate to secure the device attachment to the device. In some embodiments, the attachment further includes a removable outer cover protecting the adhesive. In embodiments, the attachment further includes a lock pin adapted to secure the hinge mount to the middle ring. In embodiments, the inner ring has a 90-degree freedom of movement between a closed position and an open position.

Another embodiment is an attachment for holding or supporting a device. This embodiment includes an outer ring attached to a backing plate for securing to a surface of the device, wherein a first recessed area extends an inner circumference of the outer ring. The attachment also includes a middle ring adapted to fit within the outer ring, the middle ring comprising a second recessed area extending an outer circumference of the middle ring, a lock ring for assembly into the first and second recessed areas, the lock ring securing the middle ring to the outer ring, wherein the secured lock ring allows the middle ring to rotate within a plane parallel to the backing plate, an inner ring adapted to fit within the middle ring, the inner ring comprising a hinge mount on an outer portion of the inner ring that is affixed to the inner ring using a lock pin and a layer of adhesive, protected by a removable outer cover, wherein the adhesive allows affixing the backing plate to a surface of the device.

In some embodiments, the attachment includes a lock pin for fixing the hinge mount of the inner ring to the middle ring. In embodiments, the inner ring is secured to the middle ring via a lock pin, the lock pin providing a hinge point allowing movement of the inner ring. In embodiments, the inner ring and the middle ring form a flat surface when the attachment is in a closed position. In embodiments, the inner ring has a shape selected from the group consisting of generally square shape, a rounded square shape, a generally rectangular shape, a rounded rectangular shape and a generally oval, or elliptical shape. In some embodiments, the inner ring has generally circular inner and outer shapes. In embodiments, the lock ring has a shape selected from the group consisting of a generally round shape and a generally oval or elliptical shape. In embodiments, the inner ring has a 90-degree freedom of movement between a closed position and a fully open position. In some embodiments, the inner ring in an open position forms a device stand for holding in place the device to which it is attached.

Another embodiment is an attachment for holding or supporting a device. The attachment includes an outer ring, a backing plate attached to the outer ring, a lock ring that fits partially within a first recess of the outer ring, a middle ring secured to the outer ring by the lock ring and an inner ring secured to the middle ring. In some embodiments, the lock ring is an O-ring that fits partially within a second recess of the middle ring. In some embodiments, the attachment includes a lock pin adapted to fit within the first recess and the second recess for securing the inner ring to the middle ring.

In embodiments, the middle ring is secured within the outer ring by the lock ring. In some embodiments, the inner ring includes a hinge mount. In some embodiments, the attachment also includes a lock pin for securing the hinge mount of the inner ring.

Another embodiment is a method for grasping a mobile electronics device, the method includes steps of securing an outer ring of an attachment to the mobile electronics device, the attachment further comprising a swiveling inner ring and a middle ring disposed between the inner and outer rings, rotating the inner ring to a desired orientation with respect to the mobile electronics device, swiveling the inner ring to an open position; and grasping the mobile electronics device via the inner ring.

These and other systems, methods, objects, features, and advantages of the present disclosure will be apparent to those skilled in the art from the following detailed description of the preferred embodiment and the drawings.

All documents mentioned herein are hereby incorporated in their entirety by reference. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context.

BRIEF DESCRIPTION OF THE FIGURES

The disclosure and the following detailed description of certain embodiments thereof may be understood by reference to the following figures:

FIG. 11 depicts a perspective view of an inner ring of the attachment device.

FIG. 12 depicts a cross-sectional view of the inner ring of FIG. 11.

Figure 1:
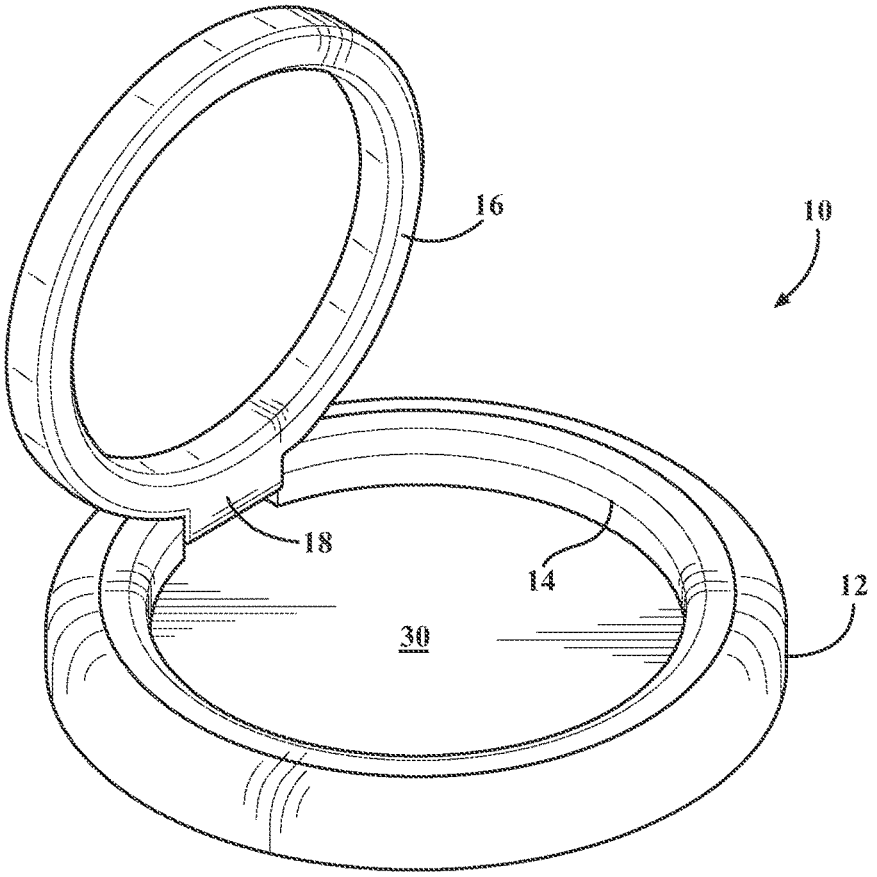
FIG. 1 depicts a perspective view of a fully open attachment device.

It is understood that there are many embodiments of the present disclosure, of which only a few are presented in these drawings.

DETAILED DESCRIPTION

The present application discloses a unique product for enhancing the functionality of hand-held devices, such as a mobile device. Affixing the attachment device, which may be known in the trade as a "amänō" to a mobile device provides a secure attachment and may allow for holding the mobile device with, for example, a single finger. With this attachment, one is able to hold and use device with confidence that the user will not drop the device, possibly causing damage. In one embodiment, the amänō or attachment device may comprise three or more separate concentric round "rings" allowing a unique edge swivel. In an example embodiment, the attachment device may include three concentric rings, the outer ring of which may be affixed to a backing plate. The bottom portion of the backing plate may be covered in an adhesive that may be used to affix the attachment device to a mobile device. The adhesive may be protected until usage by a protective film that may be removed by a user prior to affixing the backing plate to a mobile device. In embodiments, the adhesive may be a repositionable adhesive. This may allow a user to place and remove the attachment device from a mobile device, and/or use the same attachment device on a plurality of mobile devices. In embodiments, the backing plate may be affixed to the mobile device using a non-adhesive, including but not limited to a suction cup, clip, or some other means of securing the attachment device. The attachment device may include a middle ring that is positioned within the outer ring. The outer ring may have a recessed area extending the inner circumference of the outer ring that accommodates a lock ring. The middle ring may have a recessed area extending the outer circumference of the middle ring that accommodates the lock ring. The lock ring when secured within the recessed portions of the outer and middle rings may hold the middle ring secure to the outer ring and allow for swivel or rotation (possibly of 360-degree range) along the inner portion of the outer ring, where the rotation is parallel to the plane of the backing plate. An inner ring may be secured to the middle ring using a lock ring within a hinge mount. The hinge mount may allow for the inner ring to have a 90-degree range of motion, or a range of motion less than 90-degrees, from its closed position to its fully opened position. In another embodiment, the inner ring may have a greater than 90-degree freedom of movement between a closed position and a fully open position, based at least in part on utilizing a spring hinge or some other type of hinge or pivot. Because the inner ring is mounted at the hinge mount to the middle ring, the inner ring may also swivel 360-degrees, or less than 360-degrees, in conjunction with the middle ring, in full rotation around the inner perimeter of the outer ring. This may allow for a customizable fit and personalized experience for the user.

Figure 2:
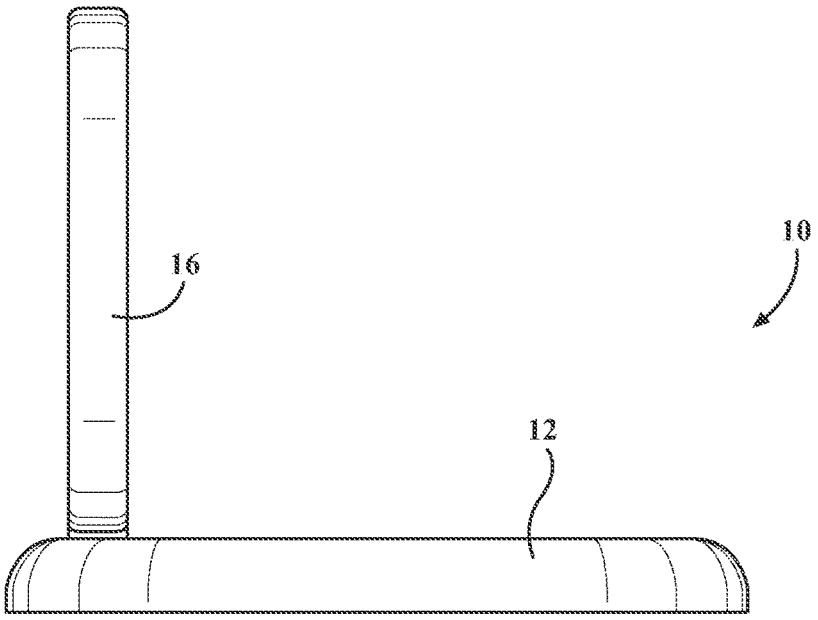
FIG. 2 depicts a side view of the attachment device of FIG. 1.
Figure 3A:
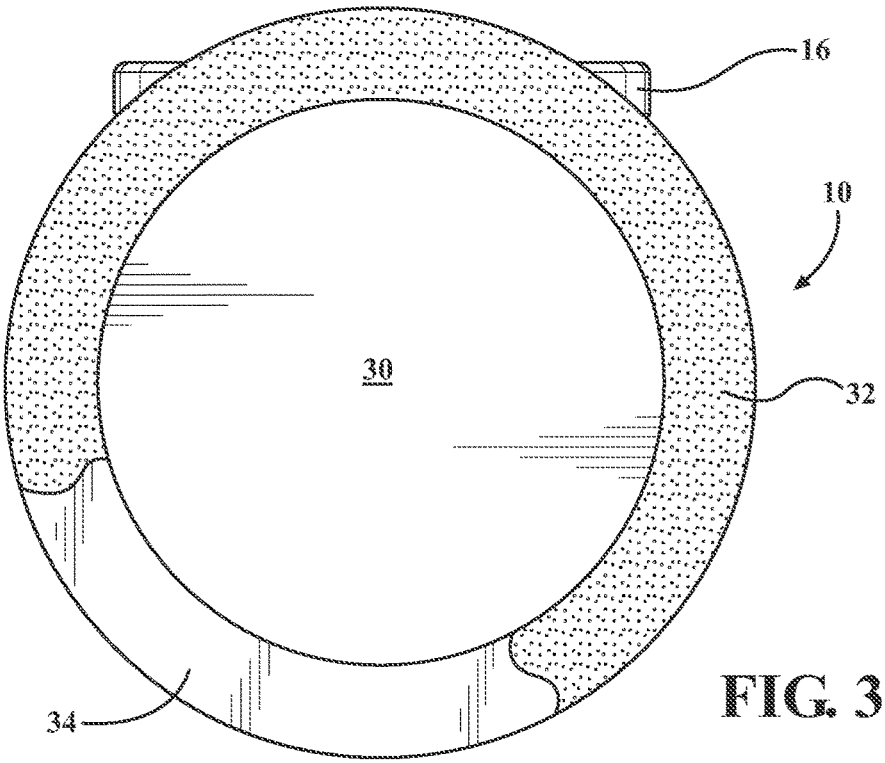
FIG. 3A depicts a bottom view of the attachment device of FIG. 1, showing adhesive applied to the perimeter of the bottom.
Figure 3B:
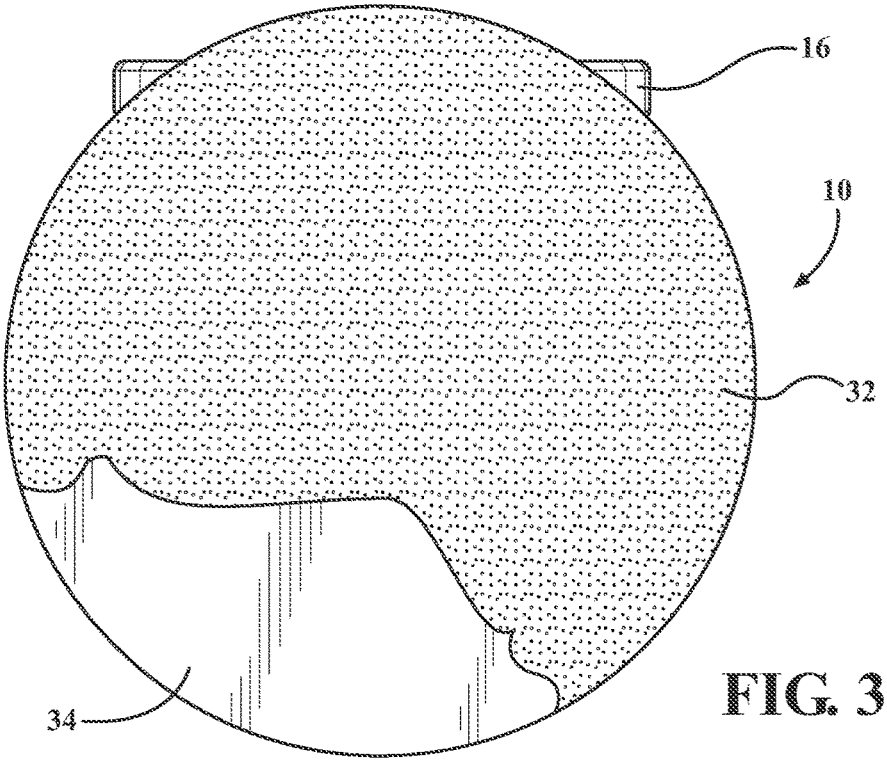
FIG. 3B depicts an alternate bottom view of the attachment device of FIG. 1, showing adhesive applied to the entirety of the bottom.

Referring to FIG. 1, the attachment device 10 includes an outer ring 12, a middle ring 14 and an inner ring 16, shown here in a fully upright position, so that a user may insert a finger, thumb, or non-human element such as a device stand or other apparatus, through the center of the ring 16. The inner ring 16 may hinge about a hinge mount 18, using a lock pin disclosed in later drawings. A side view of the attachment device 10 is shown in FIG. 2, with a bottom or outer ring 12 and the fully extended inner ring 16. As seen in FIG. 3A, the backing plate 30 of ring 10 is flat. In embodiments, the backing plate may not be entirely flat, but may for example have beveled or curved edges, a grooved surface, a patterned surface, a textured surface, or some other type of plate surface area that is not entirely flat. In addition, the backing plate bottom may include an adhesive pad 32 for securing the attachment device to a mobile device. The adhesive may cover a part of the bottom surface, as shown in FIG. 3A, or may cover the entire bottom surface, as shown in FIG. 3B. The adhesive pad may also include an outer release liner 34 for removal before adhering the device to a user instrument, such as a cell phone or a smart phone. The views of FIGS. 3A-3B also depict small portions of the upright inner ring 16 extending slightly beyond the bottom or outer ring 12, when the inner ring is in an open position, 90-degrees relative to the plane of the backing plate.

The backing plate may include a pad with a generally circular shape, a hollow circle or other desired shape. The greater the surface coverage with the adhesive, the more firmly the user device will hold the attachment device. In general, but not inevitably, the attachment device will be manufactured separately from the user devices contemplated herein. In some embodiments, the outer ring may include an adhesive pad, with no backing plate, for adhering the attachment device to the user device. In some embodiments, the adhesive may be furnished on a roll with pre-cut pads having a bottom adhesive surface for immediate application to the bottom of the attachment device. Each pad may also have an opposite side with a removable adhesive liner, so that a buyer and user of the attachment device may remove the protective removable adhesive liner and attach the attachment device to the user device of his or her choosing.

Figure 4:
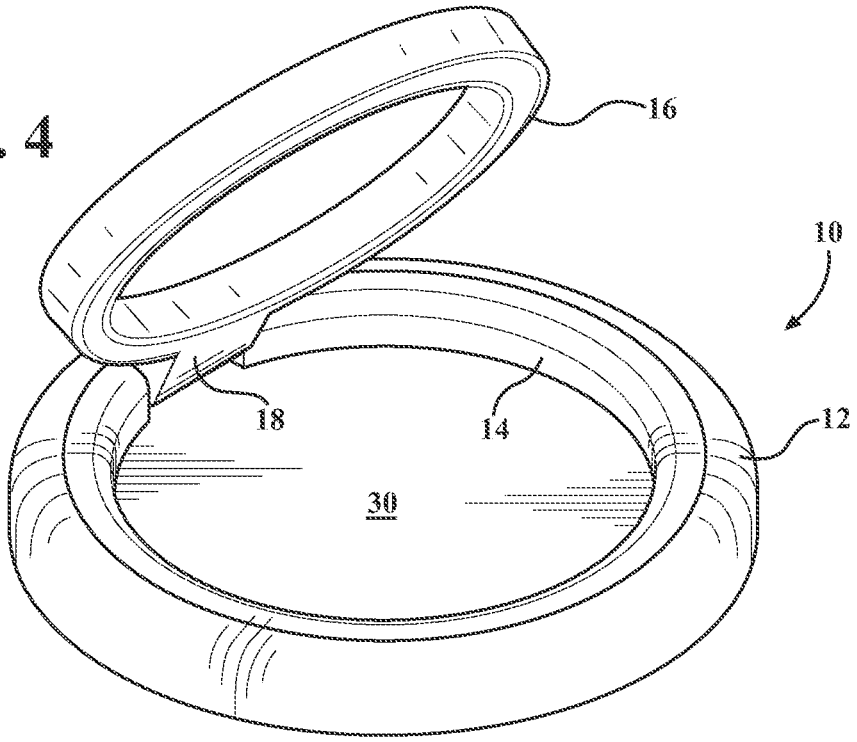
FIG. 4 depicts a partially open view of the attachment device of FIG. 1.
Figure 5:
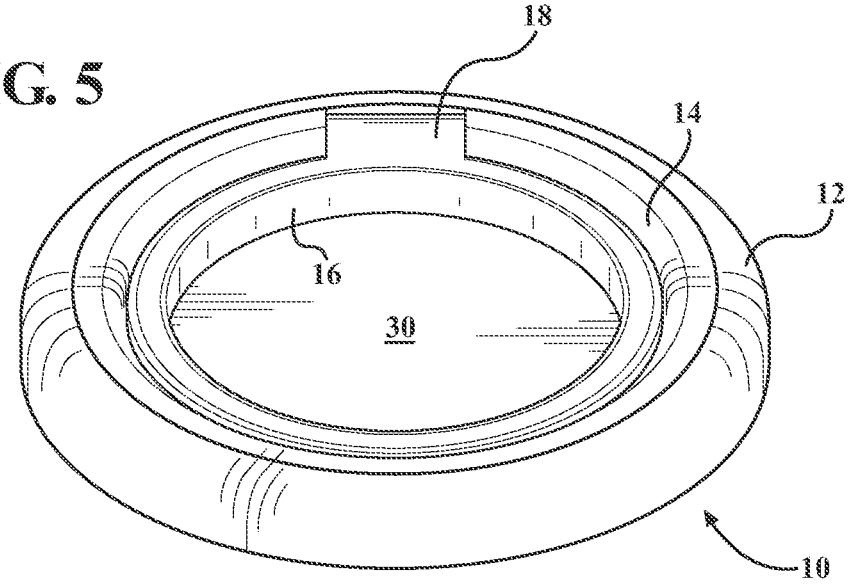
FIG. 5 depicts a front perspective closed view of the attachment device of FIG. 1.
Figure 6:
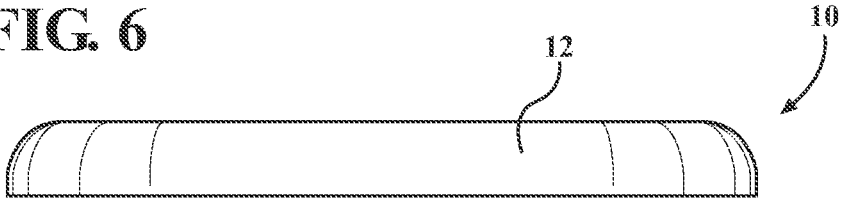
FIG. 6 depicts a side perspective closed view of the attachment device of FIG. 1.
Figure 7:
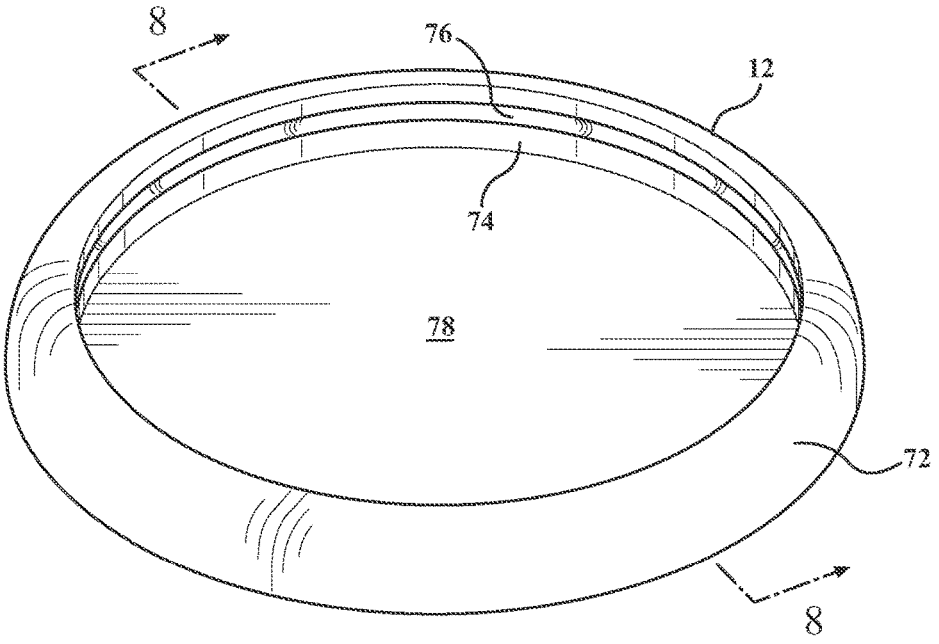
FIG. 7 depicts a perspective view of an outer ring of the attachment device.
Figure 8:
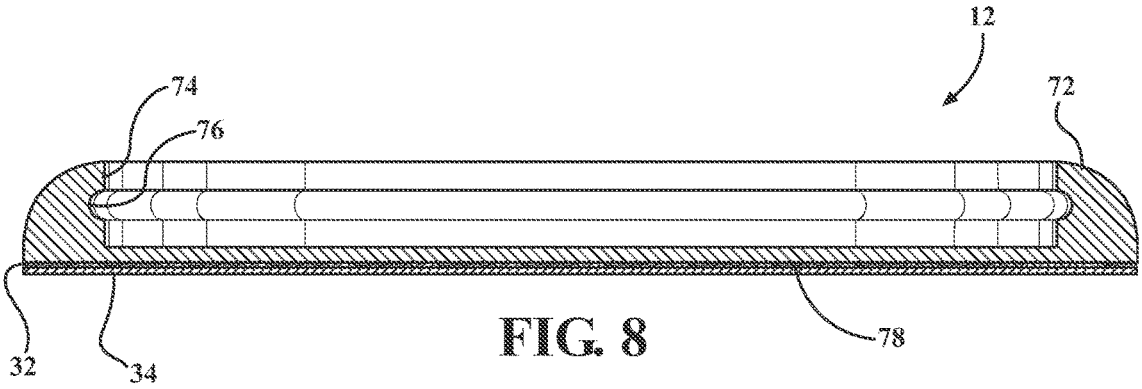
FIG. 8 depicts a cross-sectional view of the outer ring of FIG. 7.

The same attachment device 10 is depicted in FIGS. 4-6, in a partially-opened position. In FIG. 4, outer ring 12 is adjacent middle ring 14, which mounts inner ring 16 via a hinge mount 18. As seen earlier, it is possible to orient or raise inner ring 16 at a right-angle to the outer ring, and as seen below, the inner ring may also be closed up with the outer ring. In this embodiment, inner ring 16 is at about a 45-degree angle to the outer ring. In some embodiments, the hinging action of ring 16 about the hinge mount 18 is not smooth and has a degree of friction, so that when the user orients the rings as desired, and lays down the attachment device, along with a user device or user's mobile device, the orientation is maintained. The orientation of the rings does not shift of its own accord or under the weight of a small, portable user device. This may allow for the attachment device to be used as a stand for the device to which it is attached. For example, the attachment device may be used in this manner to hold a tablet computer at a 45-degree (or some other) angle while resting on a tabletop to facilitate hands-free viewing by a user of the tablet. The backing plate 30 is also visible in FIGS. 4-5. In another embodiment, friction between the inner 16, middle 14 and/or outer rings 12 may cause the movement of a ring to be minimized, slowed or halted in its rotation.

FIG. 5 is a front perspective view of attachment device 10 in a closed orientation, showing the generally flat top surface formed by outer ring 12, middle ring 14 and inner ring 16. The flatness of the top surface can be seen also in the side view of FIG. 6, in which can be seen the device 10 and the outer ring 12. In embodiments, the components of the attachment device are smooth and can be used with sometimes-expensive user devices without fear of gouging or scratching. For example, the component parts, if made of metal, plastics or composites that are sufficiently hard could scratch a user's other property, such as a tablet computer, or another user device of the type contemplated herein for use with the attachment device. Thus, if necessary, the parts may be deburred or polished, as necessary, to prevent catching on clothing, scratching of user devices or otherwise interfering with the user.

Examples of user devices which may advantageously use the attachment device include cell phones, smart phones, personal digital assistants, calculators, MP3 players, iPods, iPads, tablet computers and similar, mobile or small devices intended for digital interaction with a user. Other devices may be used as desired. In an embodiment, the attachment device may be used to hold a clipboard, pad, or other surface area. In embodiments, the attachment device may be affixed to a post, such as an adjustable post that may be used to mount the attachment device and the object to which it is attached, such as mounting to a dashboard of a car, countertop, wall, tabletop, or some other surface.

FIGS. 7-12 depict the component parts that may advantageously be used for the attachment device. In this embodiment, details of outer ring 12 are disclosed in FIGS. 7-8. Outer ring 12 includes an outer surface 72, an inner surface 74 and an inner recess 76, which may be used to accommodate a lock ring, useful for locking together outer ring 12 and middle ring 14. Note also in FIG. 7, the bottom surface 78 of outer ring 12 is solid, rather than hollow. Maintaining a solid bottom 78 allows for greater strength and stiffness in the outer ring and in the attachment device. As noted, in this example embodiment the outer ring and backing plate are one piece, the bottom surface of which provides a surface area for mounting outer ring 12 and its bottom 78 to the user device. In alternate embodiments, the outer ring and backing plate may be separate components that are affixed to one another via integral manufacture, an adhesive, a mechanical connection or some other manner of attachment.

The lock ring, as well as the other portions of the attachment device, enjoys a good deal of freedom in the materials that may be used. The lock ring may have a shape of an o-ring, i.e., a generally round shape or having a circular cross-section. The lock ring alternately may have a generally oval or elliptical shape. The lock ring may alternatively have a shape of a rounded square or rounded rectangle. The lock ring may be made of metal, elastomer, plastic, composite or some other material. The ring ideally should have sufficient flexibility to allow assembly and sufficient rigidity to resist disassembly.

Figure 9:
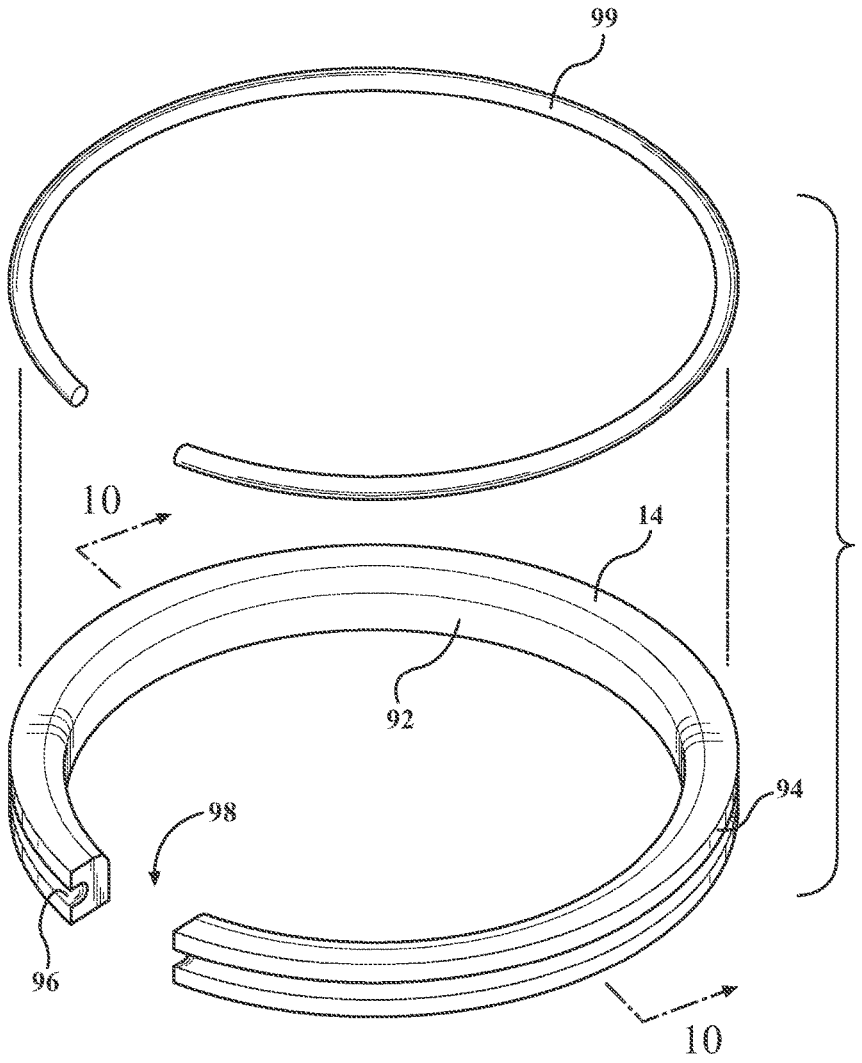
FIG. 9 depicts a perspective view of a middle ring of the attachment device.
Figure 10:
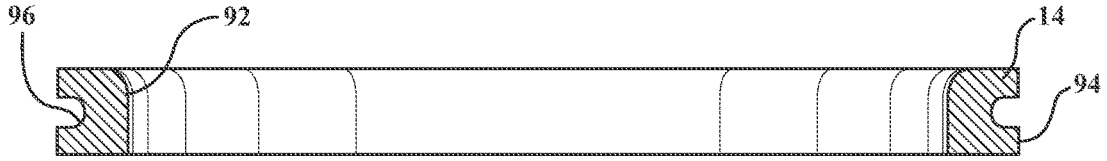
FIG. 10 depicts a cross-sectional view of the middle ring of FIG. 9.

Perspective and cross-sectional views, respectively, of an embodiment of middle ring 14 are disclosed in FIGS. 9-10. In FIG. 9, middle ring 14 includes an inner surface 92, an outer surface 94 and a recess 96 in the outer surface. The recess 96 provides space for a lock ring 99, which is used to secure the middle ring 14 to outer ring 12, using the recess 76 in the inner surface 74 of the outer ring and the recess 96 in the outer surface 94 of the middle ring 14. The lock ring 99 fills the recesses 76, 96 of the outer and middle rings and interferes with attempts to disassemble the outer and middle rings. Thus, the attachment device is strong and stable, but ultimately can be disassembled if the parts include sufficient tolerances. Middle ring 14 also includes a gap 98 to accommodate the hinge mount 18 of the inner ring. The length of lock ring 99 is a little less than the circumferential length of the recesses 76, 96, so that a lock pin can be used in this space, described below. In embodiments, parts with tighter tolerances may be considered to be permanently assembled, while parts with greater tolerances may be easier to disassemble. User devices may be safer with attachment devices having tighter tolerances and a lower chance of disassembly or failure.

Other embodiments of the device attachment may secure the outer ring to the middle ring in different ways. For example, in some embodiments when the outer and middle rings are made of plastic, they may be secured to each other with a reversible or non-reversible snap fit. In some embodiments, when the outer and middle rings are metallic, they may be assembled by interference or press fitting of the middle ring into the center of the outer ring. In other embodiments, there may be a thin bearing between the two rings, the bearing having a shape suitable for joining the two rings. There may also be a bushing between the outer and middle rings to assist in the rotational freedom of the outer and middle rings. As noted, a lock ring may be used. In other embodiments. The lock ring may have a highly defined profile for snap fitting into the outer and middle rings and joining them. In yet additional embodiments, the lock ring may be metallic, providing a press fit or interference fit for the outer and middle rings.

Details of one embodiment of the inner ring 16 are disclosed in FIGS. 11-12. Inner ring 16 includes an outer surface 112 for mating with an outer surface of middle ring 14, and also includes an inner surface 114, typically used for a user's finger. Outer surface 112 includes a hinge mount 18 with a hollow 116 for use with a lock pin 118. In practice, the lock pin is assembled into the hollow 116 with ends of the lock pin 118 protruding from the hinge mount 18. The ends of the pin rest in the hollow 96 of middle ring 14 on opposite sides of the gap 98. Recall that gap 98 is the area occupied by the hinge mount 18 when the attachment device 10 is assembled. The inner ring 16 thus hinges on the lock pin 118 which hinges on the hinge mount 18, supported by the ends of the middle ring 14. The arrangement works because the internal parts of the hinge are secured by middle ring 12. In embodiments, the lock pin 118 may be a plurality of lengths and diameters.

In embodiments, the outer ring may be affixed or adhered to the mobile device of the user. The middle ring is able to rotate a full 360-degrees about the outer ring. This rotational freedom allows a user to orient the device for use or convenience. For example, many user devices include a viewing screen, a physical keyboard or a touch-screen keyboard, and a plurality of buttons with which to manipulate or operate the device. The ability to rotate the attachment device allows the user great freedom to orient and manipulate the device. For example, the screen orientation relative to the user may be altered, from portrait to landscape, by using the swivel motion of the attachment device to rotate the device to which it is attached.

Figure 13:
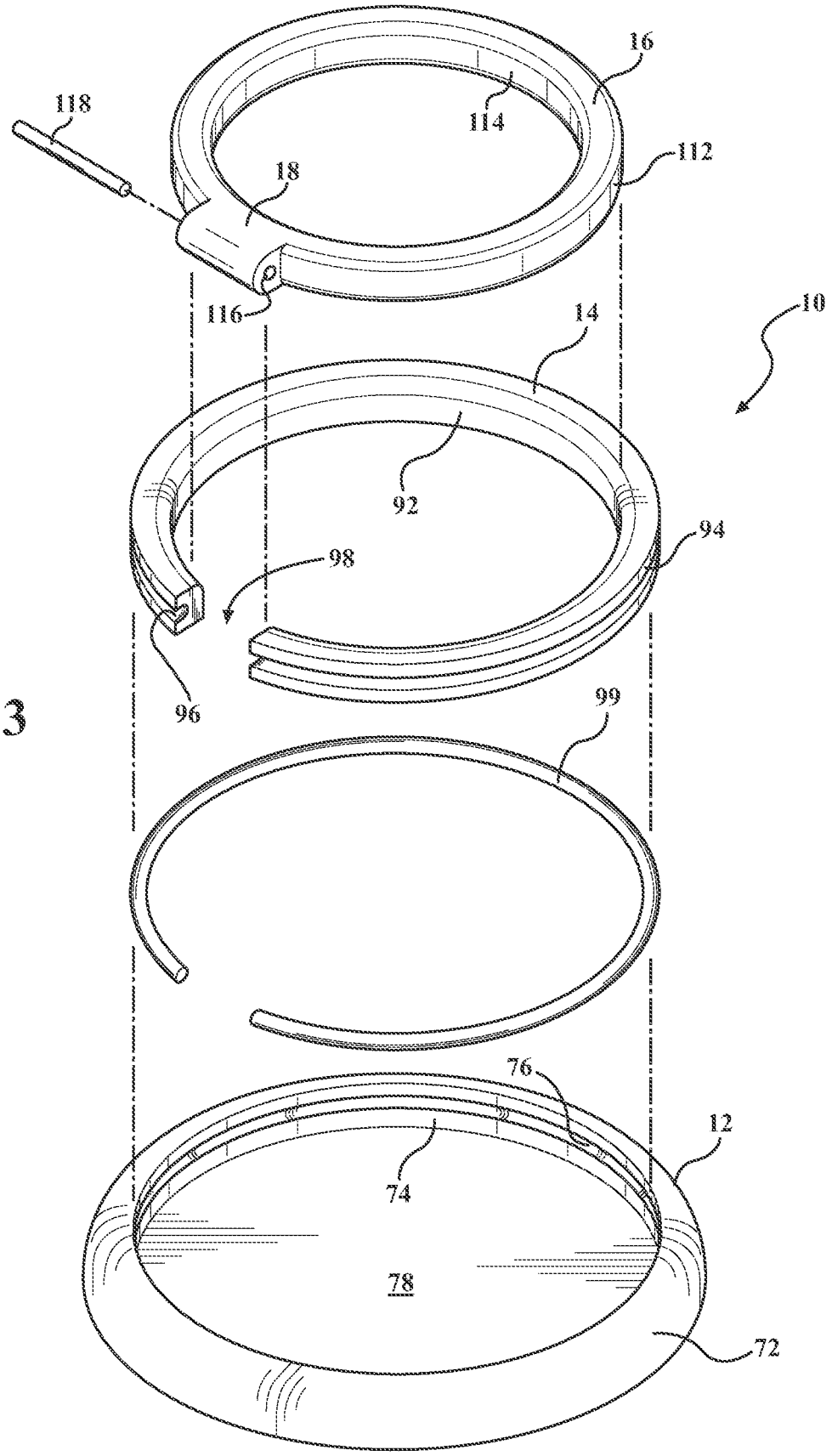
FIG. 13 depicts an exploded view of one embodiment.

An exploded view of one embodiment is disclosed in FIG. 13. The attachment device 10 includes an outer ring 12 with a backing plate 78, outer and inner surfaces 72, 74 and an internal hollow 76. Outer ring 12 is locked to middle ring 14 via lock ring 99. Middle ring 14 is disclosed with an inner surface 92, an outer surface 94 and an external hollow 96 and gap 98 on the outer surface. Lock ring 99 occupies the hollows 76, 96 to lock the rings together. Inner ring 16 includes an outer surface 112 and an inner surface 114 for accommodating a finger of a user. Inner ring 16 is assembled to middle ring 14 via hinge mount 18 and lock pin 118, which fits into hollow 116 of the hinge mount 18. Hinge mount 18 fits into the gap 98 of the middle ring, as described above.

The attachment device as disclosed herein has many advantages. The device includes many convenient features for the mobile device to which it is affixed. First and foremost it is designed to function as a "ring" that slides over a user's finger, or other means of holding a device, such as a device stand, allowing secure and confident holding of the mobile device via the attachment device. This ring is unique in that the outer ring allows 360-degree swivel of the middle ring (and inner ring based upon the inner ring being secured to the middle ring). The functionality can be separated into several distinct states. In an open state, the attachment device has several functions, and is not limited to these alone. The device acts as a ring to be used with the user's finger, or device stand, to hold the mobile device or other user device. This allows for mobile device to be firmly grasped, reducing the chance of dropping the device without the need of grasping with more than one finger. The attachment device allows the user to hold a mobile device with one finger, away from the user's palm, freeing the remainder of the hand to do other tasks. In a position in which the inner ring is left at a fixed position, the attachment device may be used to hold the mobile device at a fixed angle for viewing, such as placement on a table surface where the attachment device holds the mobile device at a 45-degree angle relative to the plane of the tabletop.

In the closed state, there are also many possible applications for the attachment device. For example, with the inner ring in a closed position and the device in a flat orientation, such as seen in FIG. 5, the attachment device may form a one finger gripping point that reduces the mobile device from sliding out of a user's hand. The device may also act as a spacer of buffer between the back of the user device and any surface the device is placed upon. This protects the finish of the mobile device by keeping it away from direct contact with a possible rough or damaging surface. The flat surface, or closed top of the attachment device, again, as seen for example in FIG. 5, may also act as a clear flat surface to apply signage and branding for custom marketing. Because of the range of motion of the inner ring, the mobile device may be easily returned to a small holding compartment, such as a pocket or purse, with the ring in a closed, flat position without the user having to accommodate the bulk of the attachment device in its opened position.

The concentric circular design disclosed herein provides a great deal of freedom for users of the disclosed device, in terms of ability to orient the device and the attachment. It is understood that the rings disclosed herein are intended to be used with actual objects and as such are only approximations of true circles. Such circular rings are able to rotate within each other. Rings of other shapes, such as ovals, will not rotate and will thus allow less freedom for the user. Many such non-rotating shapes, such as ovals, or even squares or rectangles, are still able to mount a hinge and support a lock pin. This may allow an oval, square or rectangular attachment to mount to a user device. The user may then open an inner ring, whether in a generally oval, square or rectangular shape, and use the inner shape to hold the user device. In these embodiments, an outer shape of the inner ring may be a non-rotatable shape, while providing for a generally circular inner shape or shapes to accommodate a user's finger or other object suitable for holding the user device.

While the disclosure has been disclosed in connection with the preferred embodiments shown and described in detail, various modifications and improvements thereon will become readily apparent to those skilled in the art. Accordingly, the spirit and scope of the present disclosure is not to be limited by the foregoing examples, but is to be understood in the broadest sense allowable by law.

All documents referenced herein are hereby incorporated by reference.

What is claimed is:

1. An attachment for holding or supporting a device, comprising:

an outer ring attached to a backing plate, the backing plate for securing to a surface of the device, the outer ring comprising a first recessed area on an inner surface of the outer ring;

a middle ring adapted to fit within the outer ring and adjacent to the outer ring, the middle ring comprising a second recessed area on an outer surface of the middle ring;

a lock ring for assembly into the first and second recessed areas to secure the middle ring to the outer ring, wherein the lock ring allows the middle ring to rotate within a plane parallel to the backing plate; and an inner ring adapted to fit within the middle ring, the inner ring comprising a hinge mount on an outer portion of the inner ring.

2. The attachment of claim 1, further comprising a layer of adhesive on a bottom surface of the backing plate to secure the backing plate to the device.

3. The attachment of claim 2, further comprising a removable outer cover protecting the adhesive.

4. The attachment of claim 1, further comprising a lock pin adapted to secure the hinge mount to the middle ring.

5. The attachment of claim 1, wherein the inner ring has a 90-degree freedom of movement between a closed position and a fully open position.

6. An attachment for holding or supporting a device, comprising: an outer ring;

a backing plate attached to the outer ring;

a lock ring that fits partially within a first recess of the outer ring; a middle ring secured to the outer ring by the lock ring;

an inner ring secured to the middle ring, wherein the inner ring further comprises a hinge mount; and further comprising a lock pin for securing the hinge mount of the inner ring.

7. The attachment of claim 6, wherein the lock ring comprises an O-ring that fits partially with a second recess of the middle ring.

8. The attachment of claim 7, further comprising the lock pin adapted to fit within the first recess and the second recess for securing the inner ring to the middle ring.

9. The attachment of claim 6, wherein the middle ring is secured within the outer ring by the lockring.

10. An attachment for holding or supporting a device, comprising: an outer ring;

a backing plate attached to the outer ring;

a lock ring that fits partially within a first recess of the outer ring; a middle ring secured to the outer ring by the lock ring, wherein the lock ring comprises an O-ring that fits partially with a second recess of the middle ring;

an inner ring secured to the middle ring; and a lock pin adapted to fit within the first recess and the second recess for securing the inner ring to the middle ring.

11. An attachment for holding or supporting a device, comprising: an outer ring;

a backing plate attached to the outer ring;

a lock ring that fits partially within a first recess of the outer ring; a middle ring secured to the outer ring by the lock ring;

an inner ring secured to the middle ring; and wherein the middle ring is secured within the outer ring by the lockring.

* * * * *